US007004891B2

(12) United States Patent
Morris et al.

(10) Patent No.: US 7,004,891 B2
(45) Date of Patent: Feb. 28, 2006

(54) INCLINED LEG PRESS WEIGHT TRAINING MACHINE

(75) Inventors: Michael Wayne Morris, Galax, VA (US); Gregory M. Webb, Independence, VA (US)

(73) Assignee: Nautilus Human Performance Systems, Inc., Independence, VA (US)

( * ) Notice: Subject to any disclaimer, the term of this patent is extended or adjusted under 35 U.S.C. 154(b) by 539 days.

(21) Appl. No.: 10/383,100

(22) Filed: Mar. 6, 2003

(65) Prior Publication Data

US 2004/0176223 A1 Sep. 9, 2004

(51) Int. Cl.
*A63B 21/062* (2006.01)
*A63B 21/08* (2006.01)
*A63B 21/00* (2006.01)

(52) U.S. Cl. ..... 482/101; 482/97; 482/136

(58) Field of Classification Search ..... 482/97–103, 482/104, 133–138
See application file for complete search history.

(56) References Cited

U.S. PATENT DOCUMENTS 5,106,081 A * 4/1992 Webb ..... 482/137
5,260,870 A * 11/1993 Tsuchiya et al. ..... 600/595
5,366,432 A * 11/1994 Habing et al. ..... 482/138
5,484,365 A * 1/1996 Jones et al. ..... 482/97
5,616,107 A * 4/1997 Simonson ..... 482/97
5,628,715 A * 5/1997 Simonson ..... 482/97
5,762,590 A * 6/1998 St. Fleur et al. ..... 482/97
5,827,154 A * 10/1998 Gill ..... 482/9
6,220,993 B1 * 4/2001 Sencil ..... 482/97

* cited by examiner

*Primary Examiner*—Jerome Donnelly
*Assistant Examiner*—Fenn C. Mathew
(74) *Attorney, Agent, or Firm*—Myers Bigel Sibley & Sajovec

(57) ABSTRACT

An inclined leg press machine includes: a frame that includes a base configured to rest on an underlying surface and a pair of inclined guides; a seat assembly attached to the frame; a weight sled slidably engaged with the guides along a travel path that is substantially parallel with the guides, the weight sled operatively coupled with a resistance source; and a foot platform assembly movable with the weight sled, the foot platform assembly having a foot platform that receives the feet of an exerciser. The weight sled is movable along the travel path between flexed and extended positions. The foot platform rotates relative to the underlying surface as the weight sled moves between the flexed and extended positions so that, when the exerciser's feet are placed flat on the foot platform, the exerciser's feet and tibiae are maintained at an angle of approximately ninety degrees.

35 Claims, 8 Drawing Sheets

INCLINED LEG PRESS WEIGHT TRAINING MACHINE

FIELD OF THE INVENTION

The present invention relates generally to exercise equipment, and relates more particularly to weight training equipment.

BACKGROUND OF THE INVENTION

Exercise devices, and in particular weight training machines, typically include a mechanical member that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement is the leg press, which involves straightening the legs from a position in which they are bent at approximately a ninety degree angle at the knees and in which the exerciser's knees are drawn somewhat near the chest. Generally, the leg press movement exercises the quadriceps, gluteals, and hamstrings of the exerciser.

The leg press movement can be carried with different types of apparatus. For example, some machines are configured such that the exerciser lays on his back with the thighs generally upright and applies a generally horizontal force against a foot panel with the heels. Such machines have a platform supporting the exerciser that slides rearwardly as he pushes his feet against a foot panel, or a configuration in which the foot panel moves relative to the frame in response to the exerciser pushing against it. Such a machine is exemplified by the NITRO™ Leg Press, available from Nautilus HPS, Inc., Independence, Va. As another example, machines exist in which the exerciser is in a generally upright or inclined seated position with his back placed against a backrest and applies a generally horizontal force through the heels against a foot panel. These machines can also have a design in which the seat and backrest slide relative to the frame, or a stationary seat design, in which the foot panel moves relative to the frame. An exemplary machine of this type having a stationary seat is the 2ST leg press machine, available from Nautilus HPS, Inc., Independence, Va. (also illustrated in U.S. Pat. No. 5,106,081).

Another leg press machine is the inclined leg press, which includes a stationary seat and an adjustably weighted sled that slides on inclined rails (typically the rails are disposed at an angle of between about 35 and 45 degrees to the underlying surface). Inclined leg press machines are preferred by some exercisers for several reasons: they can induce significant hip flexion and rotation during exercise; the weight resistance is typically relatively constant over the exercise stroke (which is often not the case for other machines, particularly those that rely on linkages and/or cams to transfer resistance to the exerciser); and the amount of resistance can be precisely applied (the resistance can vary for sled-type designs in which the exerciser's body moves during the exercise stroke).

One issue that can arise with leg press machines is the angle at which force is applied to the foot panel. Ideally, this force should be applied parallel to the tibia of the user (i.e., the foot panel is normal to the user's tibia) to reduce shear stress on the knee joint and to increase exercise efficiency. With a sled-type design in which the body of the exerciser moves during the exercise stroke, typically the foot panel is stationary, so the angle of the tibia to the foot panel varies as the leg straightens. With a typical simple swing arm-type design in which the foot pad moves relative to the frame, the foot panel tends to increase its angle relative to the exerciser's back as the foot panel moves away from the user. Unfortunately, this variation in angle should decrease in order to maintain the desired ninety degree angle with the tibia. One approach to address this problem is illustrated in the Nautilus 2ST leg press machine discussed above, in which a pair of swing arms interconnect with a base and a member connected to the foot pad to decrease the angle of the foot pad in the desired manner. However, this issue has not been addressed with an inclined leg press.

SUMMARY OF THE INVENTION

The present invention is directed to an inclined leg press exercise machine that can provide desirable performance properties. As a first aspect, the invention is directed to an inclined leg press machine comprising: a frame, the frame including a base configured to rest on an underlying surface and a pair of inclined guides, each of the guides having a longitudinal axis; a seat assembly attached to the frame; a sled slidably engaged with the guides along a travel path that is substantially parallel with the longitudinal axes of the guides, the sled operatively coupled with a resistance source; a foot platform assembly movable with the sled and pivotally interconnected thereto at a pivot having an axis of rotation that is substantially perpendicular to the travel path, the foot platform assembly having a foot platform; and a control linkage pivotally interconnected with the frame and with the foot platform. The sled is movable along the travel path between flexed and extended positions, and the control linkage is configured such that in the flexed position, the foot platform forms a first angle relative to the longitudinal axes of the guides, and in the extended position, the foot platform forms a second angle relative to the longitudinal axes of the guides, the second angle being greater than the first angle. This configuration can provide the desired relationship between the foot platform and the feet and tibiae of the exerciser throughout the exercise stroke.

As a second aspect, the invention is directed to an inclined leg press exercise machine that comprises: a frame, the frame including a base configured to rest on an underlying surface and a pair of inclined guides, each of the guides being hollow tubes of substantially circular cross-section and having a longitudinal axis; a seat assembly attached to the frame; a sled slidably engaged with the guides along a travel path that is substantially parallel with the longitudinal axes of the guides, the sled operatively coupled with a resistance source, the sled further including crowned rollers that reside within the guides; a foot platform assembly movable with the sled and pivotally interconnected thereto at a pivot having an axis of rotation that is substantially perpendicular to the travel path, the foot platform assembly having a foot platform; and a control linkage pivotally interconnected with the frame and with the foot platform. The crown rollers and round guides can provide smooth movement between the sled and guides, thereby facilitating exercise.

As a third aspect, the invention is directed to an inclined leg press exercise machine that comprises: a frame, the frame including a base configured to rest on an underlying surface and a pair of inclined guides, each of the guides comprising a hollow tube having a longitudinal axis; a seat assembly attached to the frame; a sled slidably engaged with the guides along a travel path that is substantially parallel with the longitudinal axes of the guides, the sled operatively coupled with a resistance source; a foot platform assembly movable with the sled and pivotally interconnected thereto at a pivot having an axis of rotation that is substantially perpendicular to the travel path, the foot platform assembly having a foot platform; a control linkage pivotally interconnected with the frame and with the foot platform; and a stop assembly mounted to the frame, the stop assembly including a stop portion movable between a retracted position, in which the stop portion resides outside the guides, and an extended position, in which the stop portion resides inside a guide. Interaction between the stop portion and the sled causes sled motion to cease, thereby defining a first rest position for the sled. Positioning of the stop interaction inside the guide can improve the safety of the machine.

As a fourth aspect, the invention is directed to an inclined leg press exercise machine comprising: a frame that includes a base configured to rest on an underlying surface and a pair of inclined guides; a seat assembly attached to the frame; a weight sled slidably engaged with the guides along a travel path that is substantially parallel with the guides, the weight sled operatively coupled with a resistance source; and a foot platform assembly movable with the weight sled, the foot platform assembly having a foot platform that receives the feet of an exerciser. The weight sled is movable along the travel path between flexed and extended positions, and wherein the foot platform rotates relative to the underlying surface as the weight sled moves between the flexed and extended positions, the orientation of the foot platform throughout the travel path being selected so that, when the exerciser's feet are placed flat on the foot platform, the exerciser's feet and tibiae are maintained at an angle of approximately ninety degrees.

DETAILED DESCRIPTION OF THE INVENTION

Figure 1:
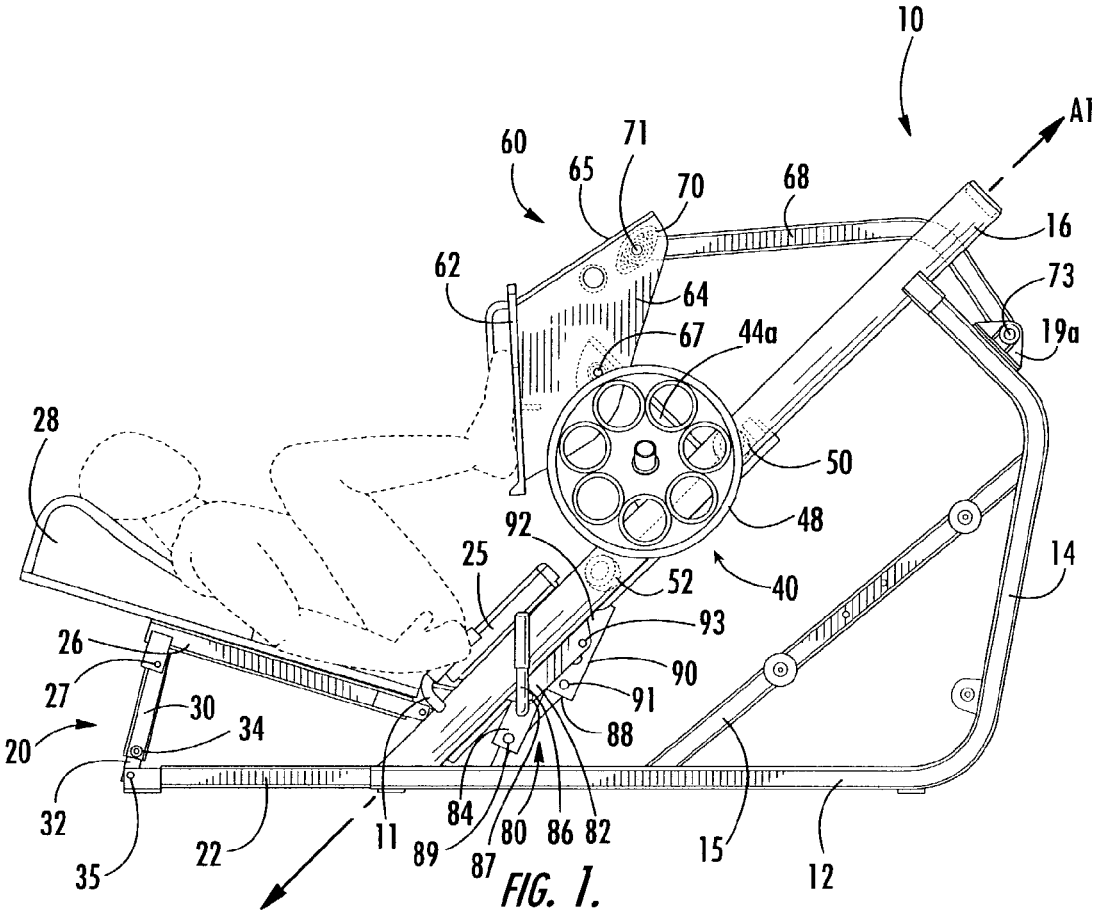
FIG. 1 is a side view of an inclined leg press machine according to embodiments of the present invention shown in its flexed position.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the figures, an inclined leg press exercise machine, designated broadly at 10, is illustrated in FIGS. 1 through 9. In describing the machine 10, it will be assumed for the purposes of description that the terms "front", "forward", and derivatives thereof refer to the horizontal direction a seated exerciser faces (i.e., to the left as shown in FIG. 1) when performing the leg press movement. The term "rear" and derivatives thereof refer to the horizontal direction that is opposite the "forward" direction (i.e., to the right as shown in FIG. 1). Together, the "forward" and "rear" directions comprise the "longitudinal" dimension of the machine 10. The terms "outward", "outer" and derivatives thereof refer to the horizontal direction defined by a vector beginning at the center of the machine 10 and extending perpendicularly to the longitudinal dimension; conversely, the terms "inner", "inward" and derivatives thereof refer to the horizontal direction opposite the "outward" direction. Together, the "inward" and "outward" directions comprise the "transverse" dimension of the machine 10.

The machine 10 includes generally a frame 12, a seat assembly 20, a weight sled 40, a foot platform assembly 60, and a stop assembly 80. These items are described in greater detail below.

Figure 9:
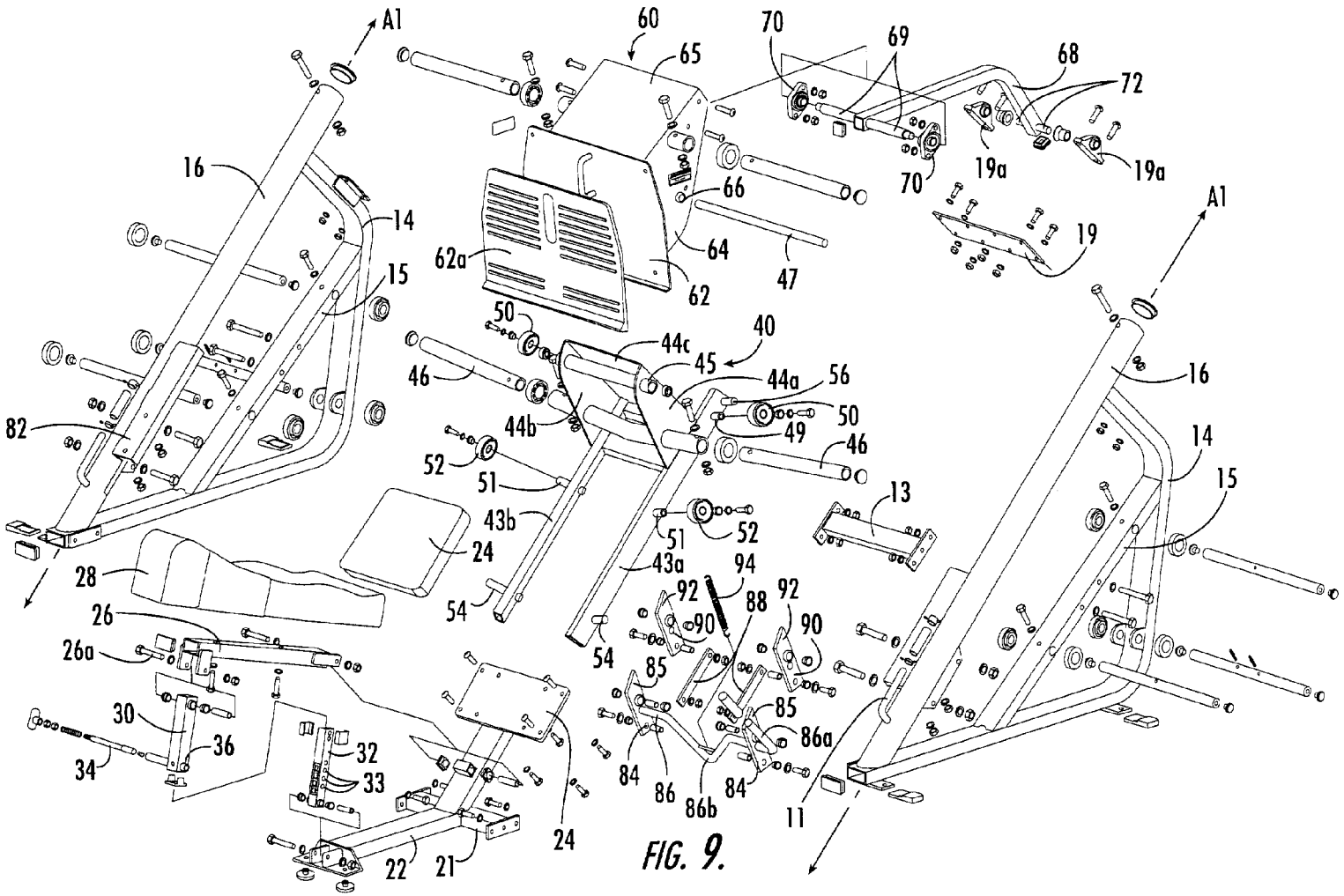
FIG. 9 is an exploded perspective view of the machine of FIG. 1.

Referring now to FIGS. 1 and 9, the frame 12 includes a pair of arches 14, each of which has a horizontal segment that rests on the ground, a vertical segment that rises from one end of the horizontal segment, and an angled tip. A brace 15 extends between each horizontal and vertical segment of each arch 14 to provide strength. The arches 14 are interconnected by a cross-brace 13 that extends between the braces 15 and by a cross panel 19 that extends between the tips of the arches 14.

Figure 5:
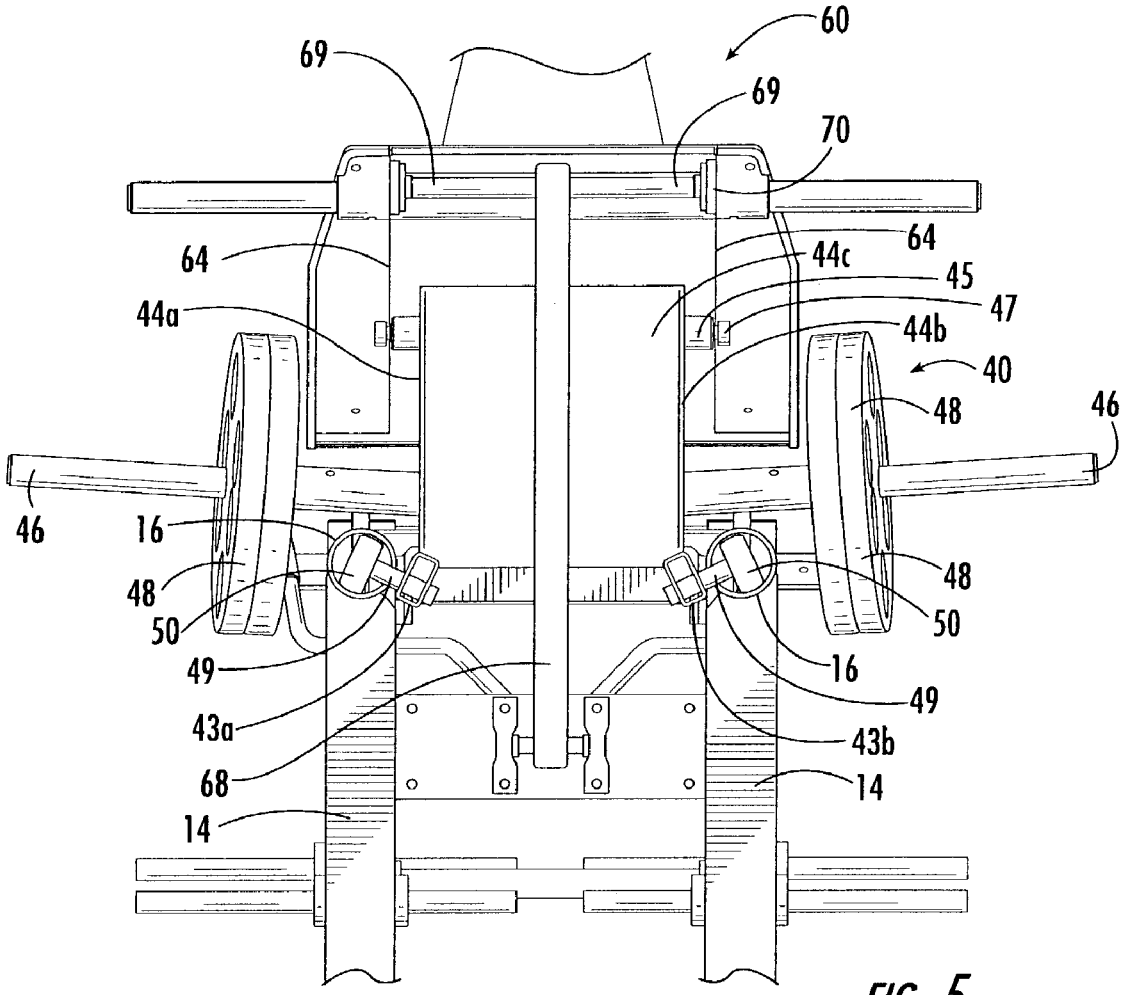
FIG. 5 is an inclined partial front view of the machine of FIG. 1 illustrating the relationship between the guides and the weight sled.
Figure 5A:
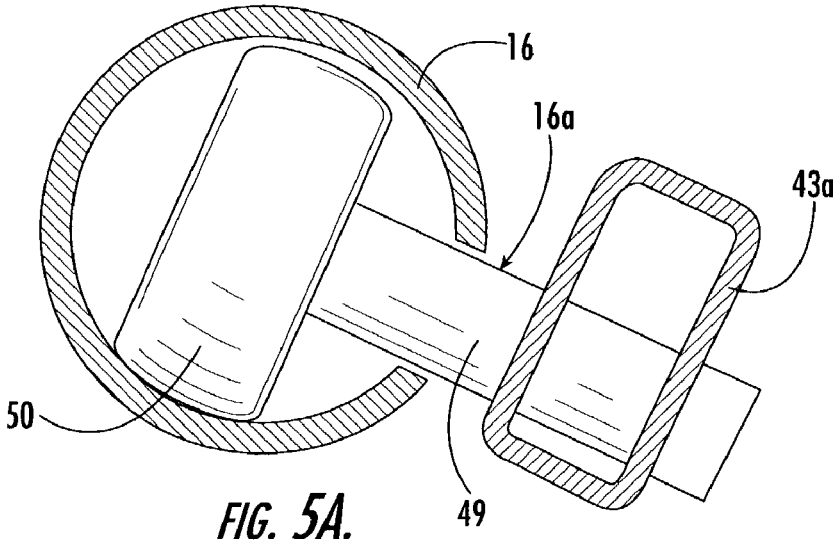
FIG. 5A is a greatly enlarged view of a guide and weight sled roller of the machine of FIG. 1.
Figure 6:
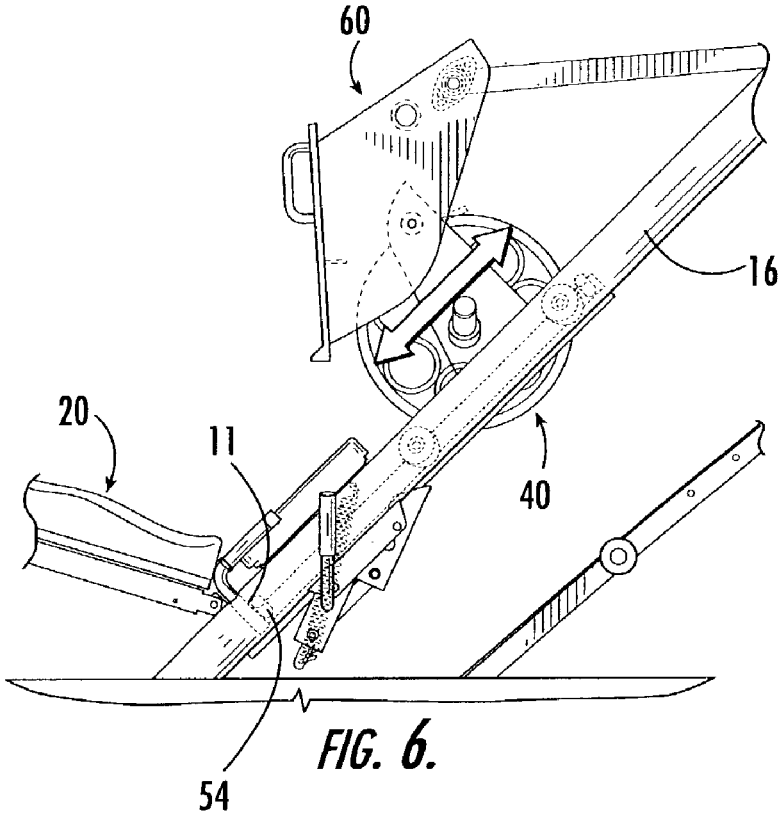
FIG. 6 is a side view of the machine of FIG. 1 with the machine in its emergency stop position.

Still referring to FIGS. 1 and 9, and also to FIGS. 5 and 5A, two tubular guides 16 of substantially circular cross-section extend upwardly and forwardly from the rearward ends of the horizontal segments of the arches 14 to and beyond the arch tips (typically, the guides 16 have longitudinal axes A1 that form an angle of between about 30 and 60 degrees with the underlying surface). Each of the guides 16 includes a slot 16*a* (FIG. 5A) that faces inwardly (i.e., toward the opposing guide 16) and extends longitudinally the length of the guide 16. One of the guides 16 also includes slots on its lower surface near the stop assembly 80 to accommodate the stop assembly 80, as will be described in detail below. A gripping handle 11 is fixed to the lower portion of each guide 16 and extends forwardly therefrom substantially parallel to the guide 16.

Those skilled in this art will recognize that the frame 12 illustrated herein is exemplary and can take many configurations that would be suitable for use with the present invention. The frame 12 provides a strong, rigid foundation to which other components can be attached at desired locations, and other frame forms able to serve this purpose may also be acceptable for use with this invention. For example, the guides 16 are preferably substantially round in cross-section (particularly if crowned rollers, such as are described below, are employed), but may take other crosssectional forms, may be open on one side rather than closed, and may engage rollers (described in detail below) on their top surfaces rather than within the cavities of the guides.

Referring again to FIGS. 1 and 9, the seat assembly 20 includes a base 22 that attaches at its forward end to a cross-member 21 that is in turn fixed to the rear ends of the arches 14. A seat post 23 rises and extends forwardly from the cross-member 21. A seat panel 24 is fixed to and extends laterally from the upper end of the seat post 23. A seat cushion 25 is fixed on the upper surface of the seat panel 24. A backrest support 26 is attached via a pivot pin 26*a* to the seat post 23 at a pivot 27. A backrest cushion 28 overlies the backrest support 27.

The rear end of the backrest support 27 is supported by a support link assembly 29, which includes a top portion 30 that is pivotally interconnected with the backrest support 27 at a pivot 31 and a bottom portion 32 that is pivotally interconnected with the base 22 at a pivot 35. The bottom portion 32 is received and is slidable within the top portion 30. The top portion 30 includes an aperture 36, and the bottom portion includes holes 33 that can align with the aperture 36 as the top portion 30 slides relative to the bottom portion 32 to adjust the length of the support link assembly 29. The length of the support link assembly 29 can be set by inserting a pin 34 into the aperture 33 and an aligned hole 33; adjustment of this length in turn sets the angle of the backrest cushion 28 relative to the seat cushion 25.

Those skilled in this art will recognize that other seat unit configurations and other mechanisms for providing seat adjustability may also be suitable for use with the present invention. For example, the seat assembly 20 may be fixed relative to the frame 12.

Referring again to FIGS. 1 and 9, and also to FIGS. 5 and 5A, the weight sled 40, which slidably engages the guides 16, includes a transversely-extending base 42 which spans two elongate rails 43*a*, 43*b*. Trapezoidal mounting plates 44*a*, 44*b* extend upwardly from respective rails 43*a*, 43*b*; the forward ends of the mounting plates 44*a*, 44*b* are bridged by a panel 44*c*. A pivot tube 45 extends transversely between upper regions of the mounting plates 44*a*, 44*b*. Also, a weight post 46 extends laterally from each mounting plate 44*a*, 44*b* for supporting one or more weights 48 during exercise (of course, other resistance sources, such as a vertical weight stack coupled to the machine 10 via cables or belts, may also be employed with the machine 10).

Still referring to FIGS. 5, 5A and 9, each rail 43*a*, 44*a* includes a front axle 49 and a rear axle 51. Crowned front and rear rollers 50, 52 are mounted on, respectively, the front and rear axles 49, 51. The rollers 50, 52 on each side of the weight sled 40 reside within a respective guide 16 of the frame 12, with the axles 49, 51 being positioned in the inwardly-facing slots of the guides 16. Rolling motion of the rollers 50, 52 within the guides 16 causes the weight sled 40 to slide relative to the guides 16. Preferably, the crown on the rollers 50, 52 is selected to substantially match the corresponding arc of the inner surfaces of the guides 16, as such a match can improve smoothness of operation. A stop pin 54 is positioned at the rear end of each rail 43*a*, 43*b*, and another stop pin 56 is positioned at the front end of each rail 43*a*, 43*b*.

Those skilled in this art will recognize that the weight sled 40 may take other configurations. For example, the crowned rollers 50, 52 may be replaced with uncrowned rollers, with spherical rollers, or simply with any component that can slidably engage the guides 16. As another example, the panel 44*c* may be omitted, or the mounting plates 44*a*, 44*b* may take a different configuration. Also, one or both of the stop pins 54, 56 may be omitted. Other modifications may also be recognizable to the ordinarily skilled artisan.

Referring again to FIGS. 1 and 9, the foot platform assembly 60 includes a foot platform 62 (which may, as illustrated, be covered with a resilient protective layer 62*a*) that is generally vertical and extends transversely to the rear of the mounting plates 44*a*, 44*b*. Two trapezoidal, vertically-disposed coupling plates 64 extend forwardly from the foot platform 62; their top edges are joined by a bridge panel 65. Each coupling plate 64 is positioned laterally of a respective mounting plate 44*a*, 44*b* and includes an aperture 66 that aligns with the pivot tube 45. A rod 47 extends through the apertures 66 and the pivot tube 45 to create a pivot 67 between the foot platform assembly 60 and the weight sled 40. Two bearings 70 are also located on the inner surfaces of the coupling plates 64 generally above the pivot 67.

Still referring to FIGS. 1 and 9, an angled control link 68 is pivotally mounted at a pivot 73 to the frame 12 via bearings 19*a* that are mounted on cross panel 19 and receive pins 72 that extend transversely from the lower end of the control link 68. At its rear end, the control link 68 has shafts 69 that extend transversely to meet the bearings 70 to form a pivot 71.

Those skilled in this art will recognize that the foot platform assembly 60 may take other configurations. For example, the coupling plates 64 may be free-standing (i.e., the bridge panel 65 may be absent), or they may take a different shape. As another example, the control link 68 may be a straight link, may be angled differently, or may be replaced by multiple links, any of which may provide a control linkage that suitable controls the movement of the foot platform assembly 60.

Figure 7:
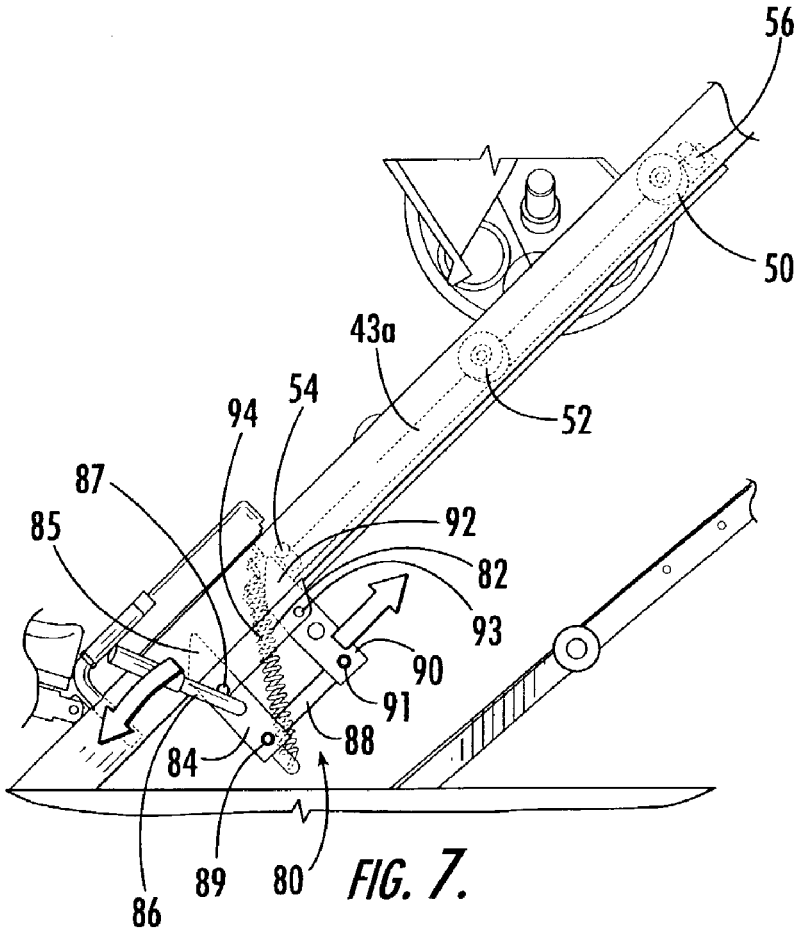
FIG. 7 is a side view of the machine of FIG. 1 with the machine in a rest position and the stop assembly in a raised condition.
Figure 8:
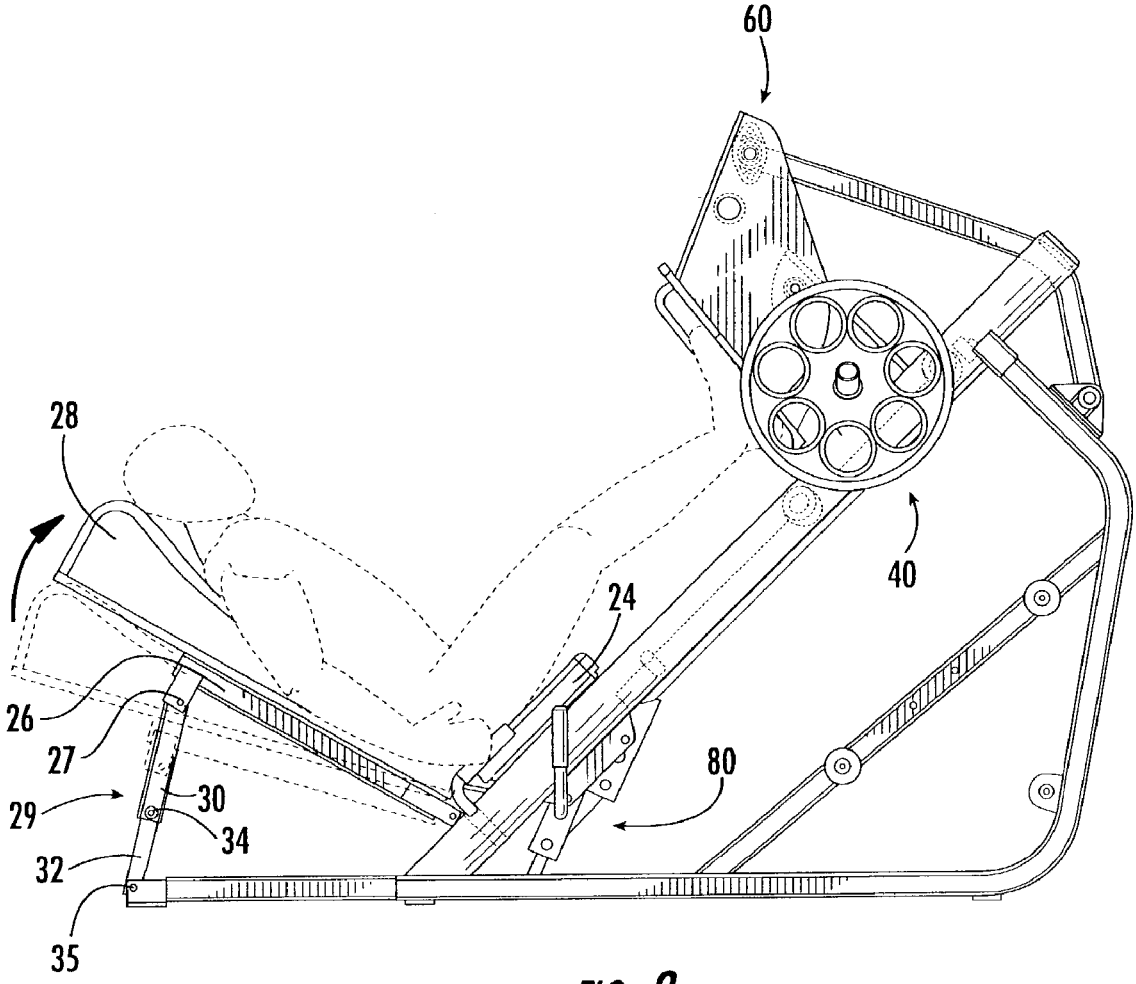
FIG. 8 is a side view of the machine of FIG. 1 illustrating pivoting of the backrest cushion to different backrest positions.

Referring to FIGS. 1, 7 and 8, the stop assembly 80 is mounted to the underside of the braces 15 with a mounting bracket 82. Two handle links 84 are pivotally interconnected with the mounting brackets 82 at pivots 87. The handle links 84 are connected with each other by a handle 86 that extends transversely to the central portion of each handle link 84; one end of the handle 86 includes an upwardly-extending grip 86*a* positioned laterally of the handle link 84. Each handle link 84 includes a stop portion 85 located upwardly from the pivot 87. A connecting link 88 is pivotally attached to the lower end of each handle link 84 at a pivot 89 and extends forwardly therefrom. A stop link 90 is pivotally interconnected with each connecting link 88 at a pivot 91 and extends upwardly to a pivot 93 with its respective mounting bracket 82. A stop portion 92 extends upwardly from the pivot 93. The stop portions 85 and 92 are sized and positioned such that they can be received within the slots (not shown) on the undersides of the guides 16. A spring 94 is attached at one end to a central, recessed portion 86*b* of the handle 86 and at its other end to the underside of the seat panel 24.

Those skilled in this art will recognize that the stop assembly 80, while preferably included on the machine 10, may be omitted entirely, or may take a different configuration. For example, either of the stop portions 85, 92 may be omitted, with the other being retained. Also, the stop assembly may be mounted to a different location on the frame 12. Other variations will be recognizable to the ordinarily skilled artisan.

When an exerciser wishes to use the machine 10, the machine 10 should begin with the weight sled 40 in a rest position (see FIG. 7). In this position, the stop assembly 80 is in its raised condition, with the handle 86 rotated such that the grip 86*a* points upwardly and rearwardly. The stop portions 85, 92 extend through the slots on the undersides of the guides 16 into the lumens of the guides 16. The weight sled 40, which is urged rearwardly and downwardly by its weight and any weights placed on the weight posts 46, is maintained in an intermediate position on the guides 16 through contact between the stop pins 54 and one of the sets of stop portions 85, 92. The weight sled 40 is shown in FIG. 7 as being maintained in position by the stop portions 92; the weight sled 40 can be maintained in a less elevated rest position (which tends to be more comfortable for shorter exercisers) by the stop portions 85 contacting the stop pins 54. One advantage that can be provided by the stop assembly 80 is that it provides stops within the lumens of the guides 16, with the result that "pinch points" for the fingers of the user and/or spotter are on the insides of the guides 16 (and, therefore, very unlikely to be accessible during typical exercise). The exercise machine 10 also has a permanent emergency stop provided by the lower ends of the gripping handles 11 (see FIG. 6).

With the exercise machine 10 in its rest position, the exerciser places a desired magnitude of weight (typically in the form of plates or disks) on the weight posts 46. The angle of the backrest cushion 28 can be adjusted by aligning a desired hole 33 with the aperture 36 and inserting the pin 34 (see FIG. 8). The exerciser then enters the machine 10, sitting on the seat cushion 25 with his back against the backrest cushion 28 and his feet placed flat on the foot platform 62.

To release the stop assembly 80, the exerciser straightens his legs, which forces the weight sled 40 to slide upwardly within the guides 16. Once the stop pins 54 have moved away from the stop portions 85, 92, the exerciser can rotate the handle 86 such that the grip 86*a* extends forwardly (see FIG. 3). This action rotates the handle links 84 and the stop links 90 about their respective pivots 87, 93 (clockwise from the vantage point of FIG. 3) so that the stop portions 85, 92 exit the slots in the guides 16. As a result, the weight sled 40 is free to slide within the guides 16.

During exercise, the exerciser alternately flexes (FIG. 1), then extends (FIG. 3) his legs in reciprocating fashion with his feet flat against the foot platform 62. Pressure on the foot platform 62 from the exerciser's feet (typically applied through the exerciser's heels) is transferred to the mounting plates 44, and in turn to the remainder of the weight sled 40. The weight sled 40 responds to the exercise movement by moving upwardly and forwardly, then downwardly and rearwardly, along a travel path defined by the slots in the guides 16 (more specifically, the front and rear rollers 50, 52 roll within the lumens of the guides 16, which causes the weight sled 40 to translate relative to the guides 16 in a direction that is parallel to the longitudinal axes of the guides 16). Thus, the weight sled 40 moves between a flexed position, in which the exerciser has his legs fully or partially flexed (FIG. 1), and an extended position, in which the exerciser's legs are fully extended (FIG. 3).

Figure 2:
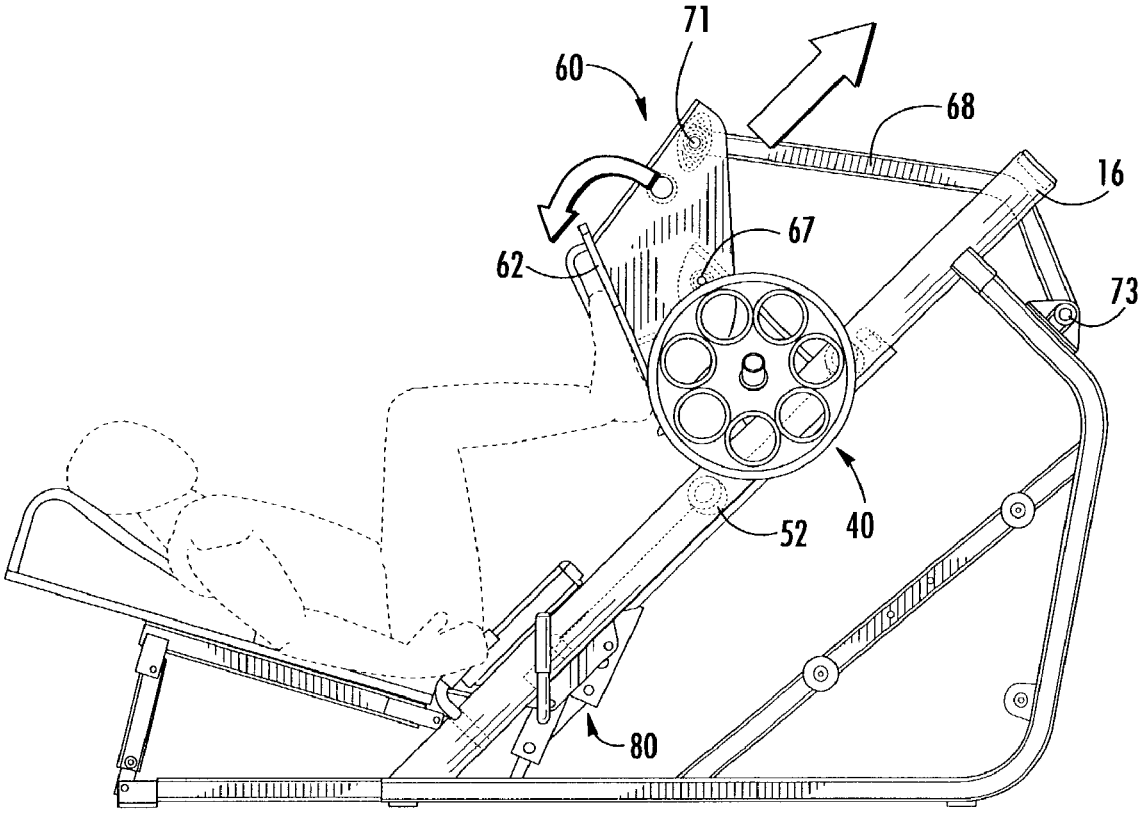
FIG. 2 is a side view of the machine of FIG. 1 shown in an intermediate position.
Figure 3:
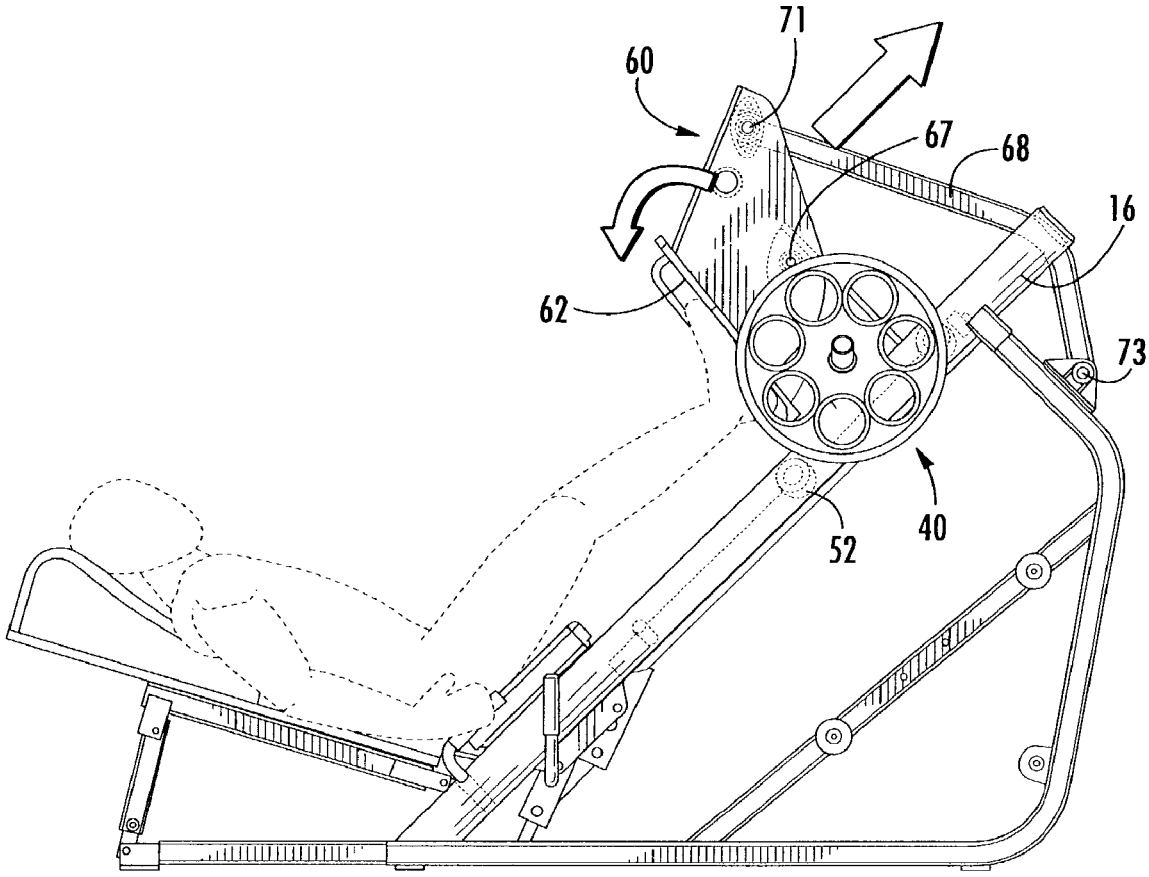
FIG. 3 is a side view of the machine of FIG. 1 shown in its extended position.
Figure 4:
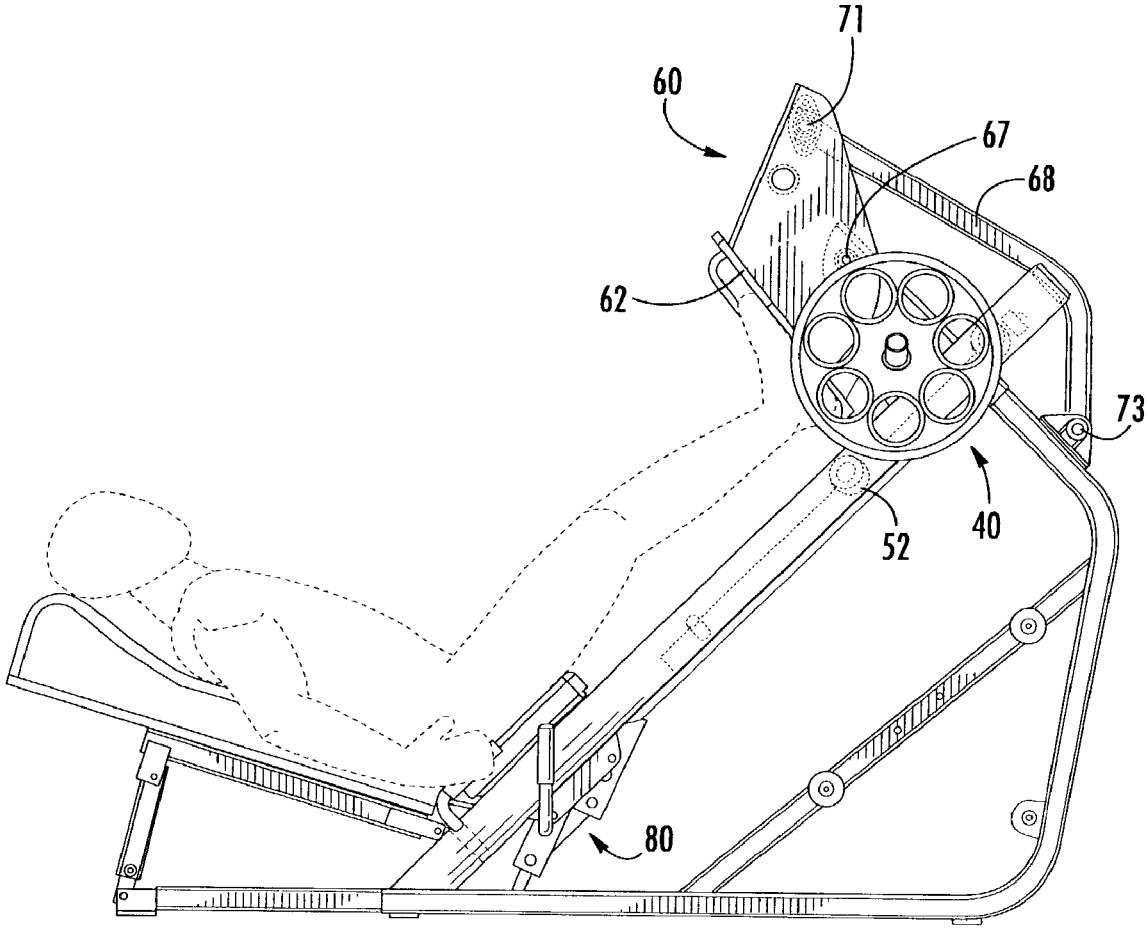
FIG. 4 is a side view of the machine of FIG. 1 shown in its extended position with a taller exerciser than that shown in FIGS. 1 through 3.

Application of force to the foot platform 62 also causes the foot platform 62 to rotate about the pivot 71 (the foot platform 62 rotates counterclockwise from the vantage point of FIGS. 1 through 3). This rotation is controlled by the control link 68, which rotates clockwise about the pivot 73. In the flexed position of FIG. 1, the plane of the foot platform 62 forms an angle with the plane defined by the guides 16 of between about 40 and 60 degrees. This angle presents the foot platform 62 to the exerciser at an orientation that enables the exerciser to push on the foot platform 62 with an angle between the tibia and foot of approximately ninety degrees. As the foot platform 62 travels (see FIG. 2), its rotation relative to the frame 12 (which is substantially continuous throughout) enables the exerciser to maintain the tibia-foot angle at approximately ninety degrees, until the foot platform 62 reaches its extended position (FIG. 3), in which it is substantially normal to the longitudinal axes of the guides 16. Notably, this approximately ninety-degree tibia-ankle position is largely maintained over the last portion of the travel path (e.g., between about 8 and 15 inches of travel), which can benefit taller users with longer legs (see FIG. 4).

It should also be noted from FIGS. 1 through 3 that the distance between the lower edge of the foot platform 62 and the guides 16 decreases as the foot platform 62 moves toward the extended position. This movement can assist in maintaining the desired relationship between the foot platform 62 and the exerciser's feet and legs. The distance remains relatively constant over the last portion of the travel path (see FIG. 4).

In addition, the arrangement of the pivots 67, 71 can assist the foot platform 62 to follow a desirable rotation while maintaining a suitable strength curve. More particularly, the location of the pivot 67 generally beneath the pivot 71 throughout the travel path of the foot platform 62 (see FIGS. 1 through 4) can produce desirable rotation of the foot platform 62 while maintaining a desirable strength curve for the exercise path. Also, the location of the pivot 73 below the plane defined by the longitudinal axes of the guides 16 (i.e. below the travel path) can also assist in producing desirable machine performance (see FIG. 1).

Those skilled in this art will also recognize that other configurations of the invention may also be suitable. For example, the guides may define an arcuate path that causes the foot panel to rotate in the desired manner while moving between the flexed and extended positions. In doing so, the foot panel may pivot relative to the sled (either through a four-bar linkage, a single pivot point, or another mechanical configuration) or be fixed relative to the sled.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. An inclined leg press exercise machine, comprising:

a frame, the frame including a base configured to rest on an underlying surface and a pair of inclined guides, each of the guides having a longitudinal axis;

a seat assembly attached to the frame;

a weight sled slidably engaged with the guides along a travel path that is substantially parallel with the longitudinal axes of the guides, the weight sled operatively coupled with a resistance source;

a foot platform assembly movable with the weight sled and pivotally interconnected thereto at a pivot having an axis of rotation that is substantially perpendicular to the travel path, the foot platform assembly having a foot platform; and a control linkage pivotally interconnected with the frame and with the foot platform;

wherein the weight sled is movable along the travel path between flexed and extended positions, and wherein the control linkage is configured such that in the flexed position, the foot platform forms a first angle relative to the longitudinal axes of the guides, and in the extended position, the foot platform forms a second angle relative to the longitudinal axes of the guides, the second angle being greater than the first angle.

2. The exercise machine defined in claim 1, wherein in the extended position, the foot platform is substantially normal to the longitudinal axes.

3. The exercise machine defined in claim 1, wherein in the flexed position, a lowermost edge of the foot platform is a first distance from the guides, and in the extended position, the lowermost edge of the foot platform is a second distance from the guides, the second distance being less than the first distance.

4. The exercise machine defined in claim 3, wherein, for the last portion of the travel path, the second angle is substantially unchanged.

5. The exercise machine defined in claim 1, wherein the foot platform rotates substantially continuously from the first angle to the second angle as the weight sled moves from the flexed position to the extended position.

6. The exercise machine defined in claim 1, wherein the resistance source comprises at least one weight.

7. The exercise machine defined in claim 1, further including a stop assembly attached to the frame, the stop assembly being movable to interact with and halt movement of the weight sled in a rest position between the flexed and extended positions.

8. The exercise machine defined in claim 1, wherein the first angle is between about 40 and 60 degrees.

9. The exercise machine defined in claim 1, wherein the control linkage comprises a control link that is pivotally interconnected with the frame and with the foot platform assembly.

10. The exercise machine defined in claim 1, wherein the guides comprise hollow tubes of round cross-section, and further comprising a pair of rollers, each attached to the weight sled and residing within the tubes.

11. The exercise machine defined in claim 10, wherein the rollers comprise crowned rollers.

12. The exercise machine defined in claim 9, wherein the weight sled includes a pair of mounting plates and the foot platform assembly includes a pair of coupling plates, each mounting plate being pivotally interconnected to a respective coupling plate at a first pivot and to the control link at a second pivot.

13. The exercise machine defined in claim 12, wherein the first pivot is generally beneath the second pivot as the weight sled moves from the flexed position to the extended position.

14. The exercise machine defined in claim 12, wherein the second pivot is below a plane defined by the longitudinal axes.

15. The exercise machine defined in claim 1, wherein the guides form an angle of between about 30 and 60 with the underlying surface.

16. An inclined leg press exercise machine, comprising:

a frame, the frame including a base configured to rest on an underlying surface and a pair of inclined guides, each of the guides having a longitudinal axis;

a seat assembly attached to the frame;

a weight sled slidably engaged with the guides along a travel path that is substantially parallel with the longitudinal axes of the guides, the weight sled operatively coupled with a resistance source;

a foot platform assembly movable with the weight sled and pivotally interconnected thereto at a pivot having an axis of rotation that is substantially perpendicular to the travel path, the foot platform assembly having a foot platform that receives the feet of an exerciser; and a control linkage pivotally interconnected with the frame and with the foot platform;

wherein the weight sled is movable along the travel path between flexed and extended positions, and wherein the control linkage is configured such that the foot platform rotates as the weight sled moves between the flexed and extended positions, the orientation of the foot platform throughout the travel path being selected so that, when the exerciser's feet are placed flat on the foot platform, the exerciser's feet and tibiae are maintained at an angle of approximately ninety degrees.

17. The exercise machine defined in claim 16, wherein in the extended position, the foot platform is substantially normal to the longitudinal axes.

18. The exercise machine defined in claim 16, wherein in the flexed position, a lowermost edge of the foot platform is a first distance from the guides, and in the extended position, the lowermost edge of the foot platform is a second distance from the guides, the second distance being less than the first distance.

19. The exercise machine defined in claim 18, wherein, for the last portion of the travel path, the second distance is substantially unchanged.

20. The exercise machine defined in claim 16, wherein the resistance source comprises at least one weight.

21. The exercise machine defined in claim 16, further including a stop assembly attached to the frame, the stop assembly being movable to interact with and halt movement of the weight sled in a rest position between the flexed and extended positions.

22. The exercise machine defined in claim 16, wherein the control linkage comprises a control link that is pivotally interconnected with the frame and with the foot platform assembly.

23. The exercise machine defined in claim 16, wherein the guides comprise hollow tubes of round cross-section, and further comprising a pair of rollers, each attached to the weight sled and residing within the tubes.

24. The exercise machine defined in claim 23, wherein the rollers comprise crowned rollers.

25. The exercise machine defined in claim 22, wherein the weight sled includes a pair of mounting plates and the foot platform assembly includes a pair of coupling plates, each mounting plate being pivotally interconnected to a respective coupling plate at a first pivot and to the control link at a second pivot.

26. The exercise machine defined in claim 25, wherein the first pivot is generally beneath the second pivot as the weight sled moves from the flexed position to the extended position.

27. The exercise machine defined in claim 25, wherein the second pivot is below a plane defined by the longitudinal axes.

28. The exercise machine defined in claim 27, wherein the guides form an angle of between about 30 and 60 with the underlying surface.

29. An inclined leg press exercise machine, comprising:

a frame, the frame including a base configured to rest on an underlying surface and a pair of inclined guides, each of the guides being hollow tubes and having a longitudinal axis;

a seat assembly attached to the frame;

a weight sled slidably engaged with the guides along a travel path that is substantially parallel with the longitudinal axes of the guides, the weight sled operatively coupled with a resistance source, the weight sled further including rollers that roll in contact with the guides;

a foot platform assembly movable with the weight sled and pivotally interconnected thereto at a pivot having an axis of rotation that is substantially perpendicular to the travel path, the foot platform assembly having a foot platform; and a control linkage pivotally interconnected with the frame and with the foot platform.

30. The inclined leg press machine defined in claim 29, wherein the rollers reside within the guides.

31. The inclined leg press machine defined in claim 30, wherein the guides are of substantially circular cross-section.

32. The inclined leg press machine defined in claim 31, wherein the rollers are crowned.

33. An inclined leg press exercise machine, comprising:

a frame, the frame including a base configured to rest on an underlying surface and a pair of inclined guides, each of the guides comprising a hollow tube having a longitudinal axis;

a seat assembly attached to the frame;

a weight sled slidably engaged with the guides along a travel path that is substantially parallel with the longitudinal axes of the guides, the weight sled operatively coupled with a resistance source;

a foot platform assembly movable with the weight sled and pivotally interconnected thereto at a pivot having an axis of rotation that is substantially perpendicular to the travel path, the foot platform assembly having a foot platform;

a control linkage pivotally interconnected with the frame and with the foot platform; and a stop assembly mounted to the frame, the stop assembly including a stop portion movable between a retracted position, in which the stop portion resides outside the guides, and an extended position, in which the stop portion resides inside a guide, such that interaction between the stop portion and the weight sled causes weight sled motion to cease, thereby defining a first rest position for the weight sled.

34. The exercise machine defined in claim 33, wherein the stop assembly comprises a second stop portion, the second stop portion being movable to an extended position within a guide such that interaction between the weight sled and the second stop portion defines a second rest position for the weight sled.

35. An inclined leg press exercise machine, comprising:

a frame, the frame including a base configured to rest on an underlying surface and a pair of inclined guides;

a seat assembly attached to the frame;

a weight sled slidably engaged with the guides along a travel path that is substantially parallel with the guides, the weight sled operatively coupled with a resistance source; and a foot platform assembly movable with the weight sled, the foot platform assembly having a foot platform that receives the feet of an exerciser and a linkage coupling the foot platform and frame;

wherein the weight sled is movable along the travel path between flexed and extended positions, and wherein the foot platform rotates relative to the underlying surface as the weight sled moves between the flexed and extended positions, the orientation of the foot platform throughout the travel path being selected so that, when the exerciser's feet are placed flat on the foot platform, the exerciser's feet and tibiae are maintained at an angle of approximately ninety degrees.

* * * * *